United States Patent [19]

Blazek et al.

[11] 4,066,116

[45] Jan. 3, 1978

[54] MOLD ASSEMBLY AND METHOD OF MAKING THE SAME

[75] Inventors: William S. Blazek, Valley City; Thomas S. Piwonka, Solon; James D. Jackson; Philip N. Atanmo, both of Cleveland Heights, all of Ohio

[73] Assignee: TRW Inc., Cleveland, Ohio

[21] Appl. No.: 653,383

[22] Filed: Jan. 29, 1976

[51] Int. Cl.[2] ..... B22C 9/04; B22C 9/22

[52] U.S. Cl. ..... 164/17; 164/23; 164/34; 164/137; 164/349; 164/DIG. 15

[58] Field of Search ..... 164/17, 23, 27, 34, 164/35, 36, 137, 349, 361, 364, 365, 368, DIG. 15, 24, 25, 26

[56] References Cited

U.S. PATENT DOCUMENTS

| | | | |
|---|---|---|---|
| 2,848,774 | 8/1958 | Petty | 164/27 |
| 2,871,528 | 2/1959 | Schilling | 164/35 |
| 3,669,177 | 6/1972 | Ingolls et al. | 164/27 X |
| 3,840,971 | 10/1974 | McDonald | 164/17 X |
| 3,848,654 | 11/1974 | Boyle et al. | 164/137 X |

*Primary Examiner*—Ronald J. Shore

[57] ABSTRACT

A segmented mold assembly is utilized to cast a turbine engine component having an annular inner wall and an annular outer wall which are interconnected by a plurality of struts or vanes. The mold assembly includes a plurality of sections which are formed of a ceramic mold material and are interconnected at flange joints. A pair of mold sections are advantageously formed simultaneously by repetitively dipping a single pattern in a slurry of liquid ceramic mold material to form a wet coating on the pattern. This wet coating of ceramic mold material is then dried. After a covering of the desired thickness has been built up by repetitively dipping and drying the coatings on the wax pattern, the wax pattern is destroyed. To facilitate separating the mold sections after destroying the wax pattern, at least some of the wet coatings are wiped away in an area between portions of the wet coatings which will eventually form the mold sections.

33 Claims, 15 Drawing Figures

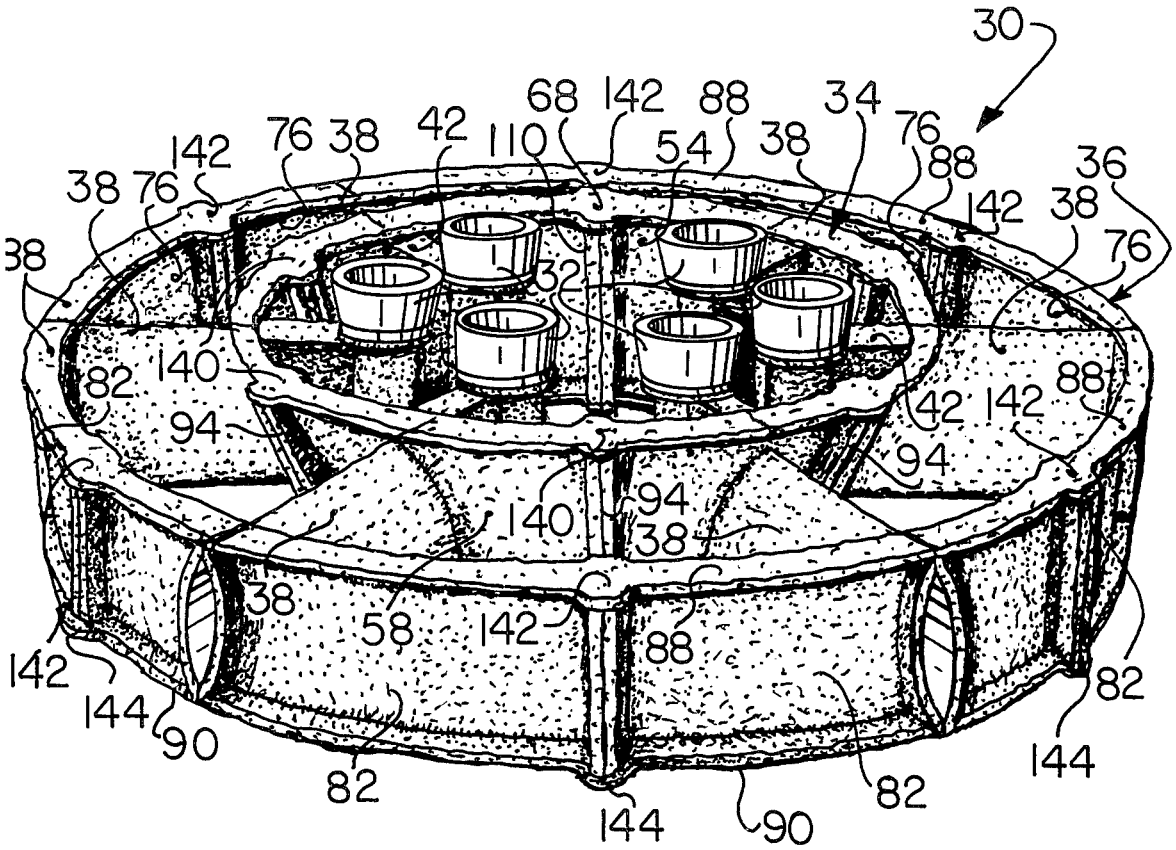
FIG. 2
FIG. 3
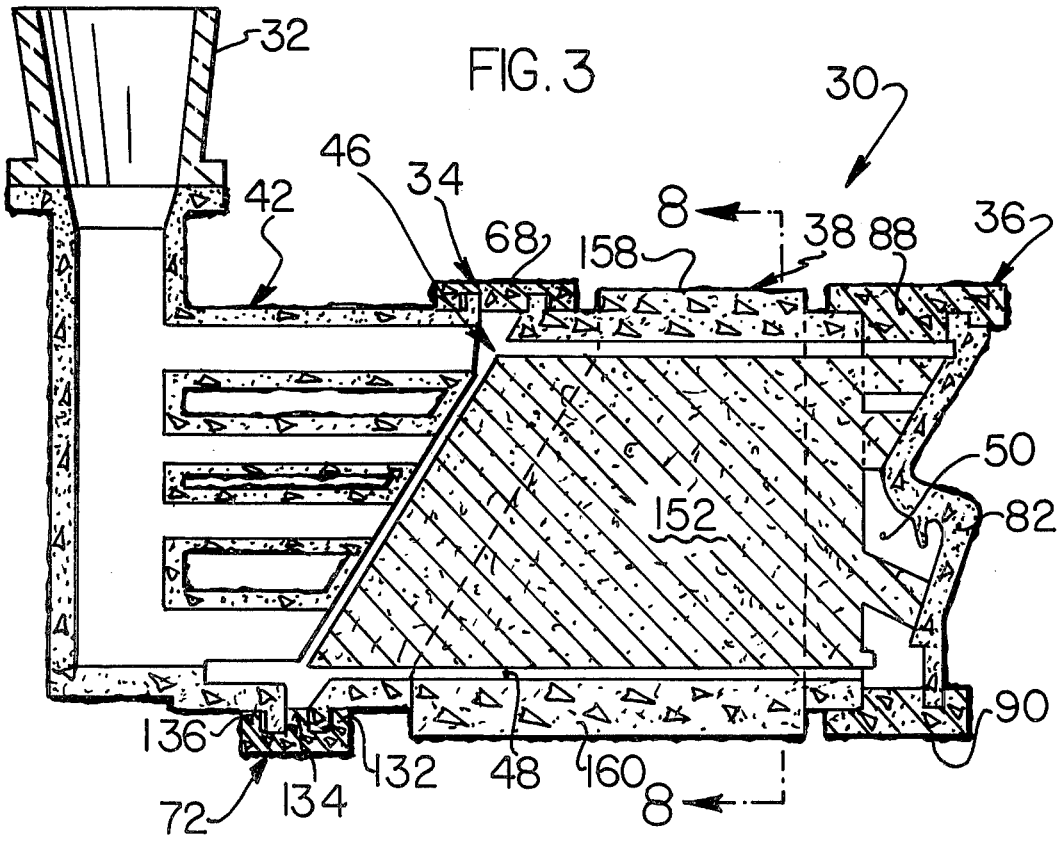

MOLD ASSEMBLY AND METHOD OF MAKING THE SAME

BACKGROUND OF THE INVENTION

This invention relates to a new and improved mold assembly and a method by which it is made and more specifically to a segmented ceramic mold assembly which may advantageously be utilized in the casting of many different items. Among these items are turbine engine components such as diffuser cases, nozzle rings, vane assemblies, bearing supports and fan frames.

Relatively large turbine engine components, such as fan frames for turbojet engines, have previously been fabricated from a multitude of small castings, sheet metal panels and sections of machined bar forging. These various components are assembled into a jet engine fan frame having an annular hub or inner wall and an outer ring or wall which are interconnected by a plurality of struts or vanes. The struts are hollow to provide for deicing and to enable fluid conduits and other parts extending between the hub and outer ring to be enclosed within the struts. Certain known jet engine fan frames have a relatively large diameter outer ring, for example one particular jet engine fan frame has an outer ring of a diameter of more than forty inches. Heretofore, the casting of a one-piece jet engine fan frame having a relatively large diameter and the requisite dimensional tolerances has been extremely difficult if not impossible.

Relatively small diameter jet engine fan frames have been previously cast from one-piece ceramic molds which are formed by a lost wax process. This process involves the repetitive dipping of a wax pattern in a slurry of ceramic mold material and drying the material between the dip coatings. After a covering of a desired thickness has been built up on the wax pattern, the pattern is destroyed by melting and the mold is fired to have the desired strength. After firing, molten metal is poured into the mold to accurately form a cast part. The manner in which wax patterns are repetitively dipped and dried during the formation of a ceramic mold is well known and is disclosed in numerous patents, including U.S. Pat. Nos. 3,675,708; 3,422,880; 2,961,751; and 2,932,864.

Due to the fact that the wax patterns must be repetitively dipped in a body of liquid ceramic mold material, only relatively small patterns have been commonly utilized to form relatively small molds. Since the molds formed in this manner are integrally formed as one piece, it is extremely difficult, if not impossible, to detect and repair imperfectly formed interior mold surfaces. This can result in a substantial percentage of scrap even though only small parts are being formed. In addition, the closed integral nature of these known investment casting molds makes it extremely difficult to coat selected areas of the interior mold surface with inoculants which promote solidification of the metal poured into the mold in a desired manner.

To some extent, the difficulties resulting from the forming of a one-piece mold have been overcome by forming ceramic molds in a plurality of parts in the manner disclosed in U.S. Pat. Nos. 3,888,301; 3,802,482; 3,669,177; and 3,048,905. Ceramic type mold cores have been made in the manner disclosed in U.S. Pat. No. 3,675,708. In addition, molds of non-ceramic materials have been previously formed in a plurality of sections in the manner disclosed in U.S. Pat. Nos. 2,848,774 and 2,789,331. The cost of forming ceramic molds in the manner disclosed in at least some of the aforementioned patents is contributed to by the fact that an area between segments of a mold must be abraded or cut away to form the separate mold sections. Since the ceramic material forming the mold sections is extremely hard, this cutting away or abrading of the ceramic mold material is both difficult and time consuming.

SUMMARY OF THE PRESENT INVENTION

The present invention provides an improved method of making an improved mold assembly. Although it is contemplated that the improved method could be utilized to make molds for shaping many different objects, the method is advantageously utilized in making a relatively large mold assembly which is utilized in the casting of a one-piece turbine engine component. The mold assembly includes a plurality of relatively small sections or segments which are interconnected to form the relatively large mold assembly. Since relatively small mold sections are interconnected to form the large mold assembly, relatively small wax patterns can be utilized to form each of the mold sections. The mold sections are advantageously interconnected at flange joints which may have a generally Z-shaped cross sectional configuration.

To form a mold section or segment, a relatively small wax pattern is utilized. This wax pattern has at least two surface areas. The first of these pattern surface areas has a configuration corresponding to the desired shape of a portion of a casting surface. The second pattern surface area does not correspond to any portion of the desired mold section. The entire pattern is repetitively dipped in a slurry of ceramic mold material. Each time the wax pattern is dipped, the resulting coating of wet ceramic mold material is dried so that a covering of ceramic mold material is built up on the wax pattern.

In accordance with one feature of the present invention, after the pattern has been dipped the wet ceramic coating is wiped away over at least a part of the second pattern surface which does not correspond to any portion of the desired mold section. This wiping action separates the wet ceramic coating overlying the surface area of the pattern corresponding to a desired mold section shape from the other portion of the wet ceramic coating.

If the wiping step is performed after each dipping step, the wax pattern is exposed in an area which circumscribes the portion of the wet coating which overlies the surface area of the pattern having the desired mold section configuration. However, it is contemplated that the wax pattern may not be wiped after the initial dipping step so that a relatively thick covering of ceramic mold material will overlie the surface area of the pattern corresponding to the desired mold section configuration and a relatively thin easily broken covering of the ceramic material will be formed immediately adjacent to this relatively thick covering. Once the covering of the desired thickness has been built up over the portion of the pattern having a configuration corresponding to the desired mold section configuration, the pattern is destroyed by a melting operation. After the pattern has been melted away, a separate mold section having the desired configuration is released. Of course, if the wet ceramic coating was not wiped away after an initial dipping of the wax pattern, a relatively thin easily broken area of the ceramic coating would have to be ruptured in order to break away the mold section from the remainder of the ceramic covering.

After the required number of mold sections have been formed in this manner, inspected for defects and repaired if necessary, the mold sections are interconnected to form a mold assembly for casting a relatively large part, such as a jet engine fan frame. However, it should be understood that the method of the present invention could advantageously be utilized in the constructing of a mold assembly to form relatively small parts, such as turbine blades. Since the mold assembly is made up of relatively small sections, relatively small patterns are utilized so that pattern breakage and flexing is minimized during the dipping of the pattern to thereby provide superior dimensional control. Of course, the visual inspection of the surfaces of each of the mold sections prior to assembling the mold sections tends to minimize scrap and thereby reduce the cost of producing relatively large one-piece molded objects.

Accordingly, it is an object of this invention to provide a new and improved method of making a mold assembly having a plurality of sections which are formed by coating a pattern and wiping away a portion of the wet coating.

Another object of this invention is to provide a new and improved method of making a mold assembly having a plurality of sections by repetitively dip coating disposable patterns in a liquid ceramic mold material and drying the dip coatings on the patterns to provide mold sections which are joined together to form the mold assembly.

Another object of this invention is to provide a new and improved method of making a mold assembly which is utilized in casting a one-piece turbine engine component having a circular inner wall and a circular outer wall interconnected by a plurality of radially extending struts and wherein the method includes the steps of providing a plurality of patterns which are coated with ceramic mold material to form inner wall, outer wall and strut mold sections which are interconnected to form the turbine engine component mold assembly.

Another object of this invention is to provide a new and improved turbine engine fan frame mold assembly having a hub, outer ring and struts which are made up of a plurality of interconnected mold sections.

BRIEF DESCRIPTION OF THE DRAWINGS

The foregoing and other objects and features of the present invention will become more apparent upon a consideration of the following description taken in connection with the accompanying drawings wherein:

FIG. 2 is an illustration of a mold assembly utilized to cast the jet engine fan frame of FIG. 1 and constructed in accordance with the present invention;

FIG. 3 is a radial sectional view further illustrating the configuration of various sections of the mold assembly of FIG. 2;

DESCRIPTION OF SPECIFIC PREFERRED EMBODIMENTS OF THE INVENTION

MOLD ASSEMBLY

Figure 1:
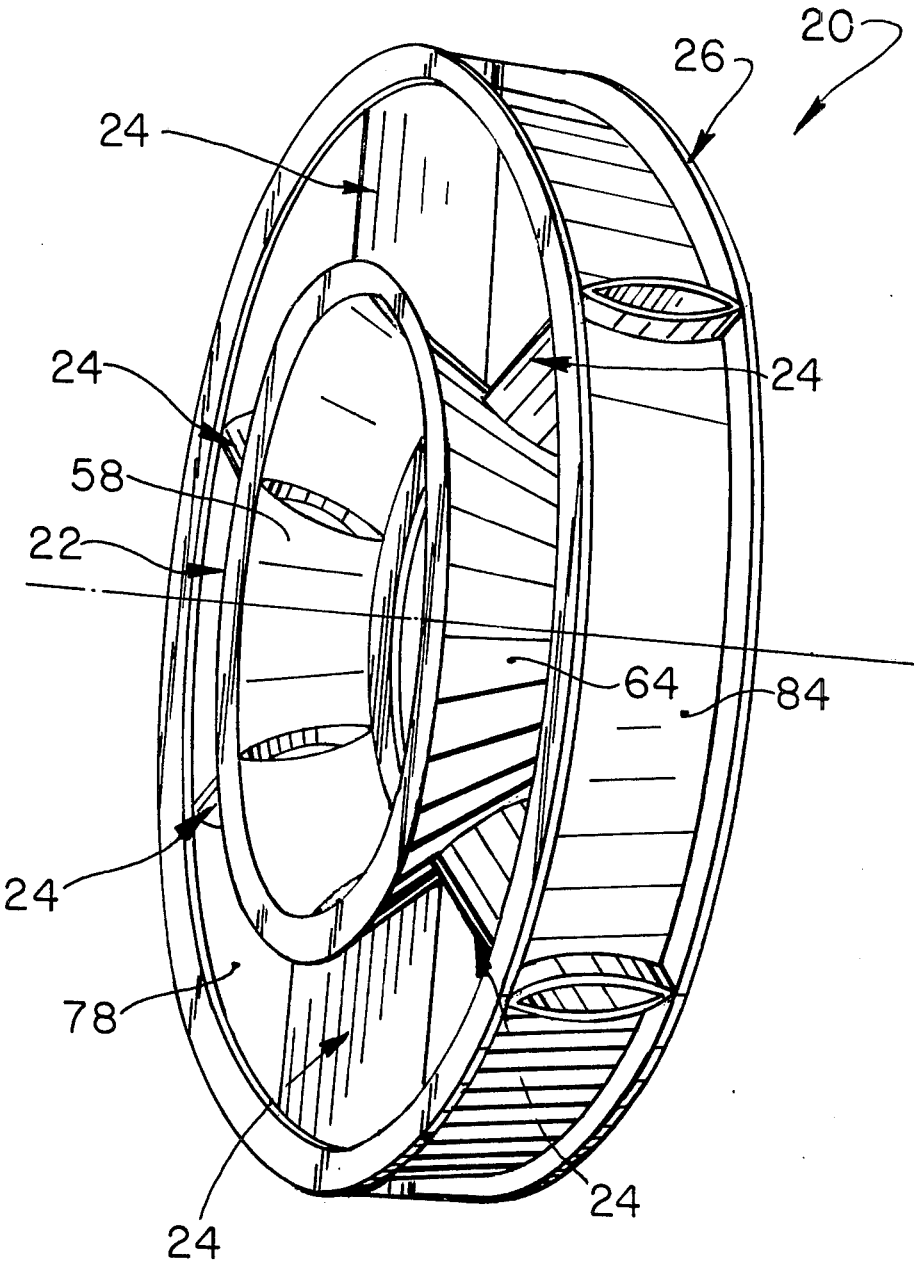
FIG. 1 is an illustration of a cast turbojet engine fan frame.

A fan frame or inlet duct 20 for a turbojet engine is illustrated in FIG. 1. The jet engine fan frame 20 has an annular central hub or wall 22 from which a plurality of struts or vanes 24 extend radially outwardly to a relatively large diamter annular outer ring or wall 26. When the fan frame 20 is installed in a turbojet engine, the inner wall or hub 22 supports one end of the compressor rotor. The struts or vanes 24 direct air flow back to the compressor through the space between the outer ring or wall 26 and hub. The hollow struts 24 are also utilized to enclose conduits and other parts (not shown) leading between the outside of the outer ring 26 and the interior of the hub 22.

Since the outer ring 26 of the jet engine fan frame 20 has a relatively large diameter, that is a diameter in excess of forty inches, and since relatively close dimensional tolerances are required to fabricate a fan frame which will function properly in a jet engine, relatively large fan frames have previously been fabricated by joining a large number of castings, sheet metal details and forgings to form a completed assembly. Although only jet engine fan frame 20 has been illustrated in FIG. 1, it should be understood that the present invention can advantageously be utilized in the forming of other turbine engine components. Among these other turbine engine components are diffuser cases, nozzle rings, vane assemblies and bearing supports.

According to one feature of the present invention, the jet engine fan frame 20 is cast in one piece in a segmented mold assembly 30 (see FIG. 2). The mold assembly 30 includes a plurality of sprue or pour cups 32 which are disposed within a hub portion 34 of the mold assembly. The hub portion 34 of the mold assembly 30 is connected with an annular outer ring portion 36 of the mold assembly by a plurality of radially extending strut portions 38 of the mold assembly.

As is perhaps best seen in FIG. 3, each of the pour cups 32 is connected in direct fluid communication with the hub portion 34 of the mold assembly 30 by gating 42. The hub portion 34 of the mold assembly 30 is in turn connected in fluid communication with the outer ring 36 of the mold assembly through the struts 38. Although the illustrated gating 42 only connects the pour cup 32 with the hub portion 34 of the mold assembly 30, additional gating and/or pour cups could be provided in association with the outer ring portion 36 of the mold assembly if desired. Upon a pouring of molten metal into the pour cups 32 of the mold assembly 30, the metal flows into an annular hub mold cavity 46 (FIG. 3), the radially extending strut mold cavities 48 and into an annular outer ring mold cavity 50. This results in an integrally cast jet engine fan frame 20 having a one-piece construction.

In accordance with another feature of the present invention, the mold assembly 30 is formed of a plurality of mold sections which are interconnected to define the various mold cavities 46, 48 and 50. Although the jet engine fan frame mold assembly 30 is relatively large, by forming the mold assembly 30 of a plurality of small mold sections, it is possible to accurately form each of the mold sections. These mold sections may then be placed in a jig or locating frame to accurately position them relative to each other and are cemented or otherwise interconnected to form a unitary assembly.

Figure 4:
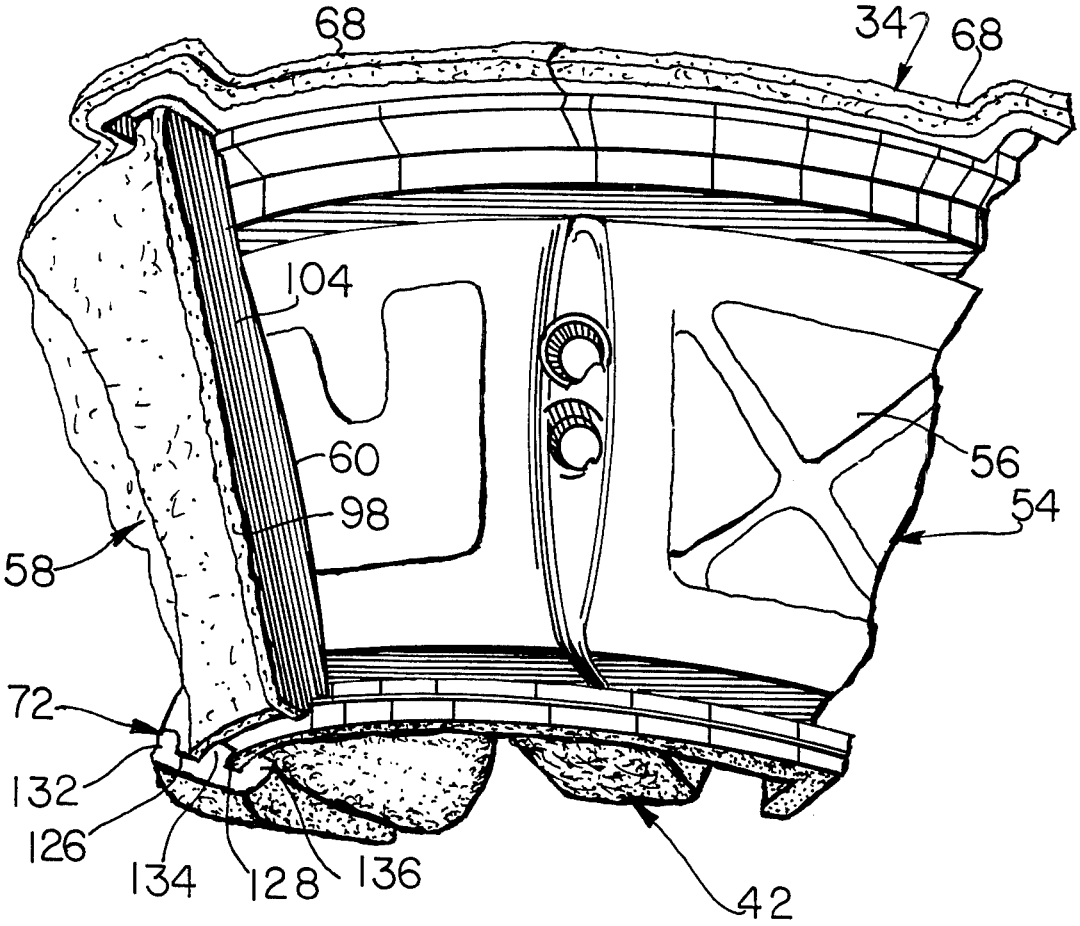
FIG. 4 is a fragmentary upwardly facing view of a hub portion of the mold assembly of FIG. 2 with some of the mold sections removed to further illustrate the segmented construction of the mold assembly.

The various mold sections are constructed in such a manner that the surfaces which define the various mold cavities can be readily inspected prior to construction of the mold assembly 30. Of course, if any defects are noted during the inspection they are either repaired or a properly formed mold section is substituted for the defective mold section. To this end, the hub portion 34 of the mold assembly 30 includes a circular array of hub panel mold sections 54 (see FIG. 4) having major side surfaces 56 with a configuration corresponding to the configuration of portions of an annular inner side surface 58 (see FIG. 1) of the jet engine fan frame hub 22. A second circular array of hub panel mold sections 58 are disposed radially outwardly of the hub mold panel sections 54 (see FIG. 4). The hub panel mold sections 58 have major inner side surfaces 60 of a configuration corresponding to the configuration of portions of the outside surface 64 (see FIG. 1) of the hub 22.

A plurality of top caps or end walls 68 extend between the coaxial circular array of hub panel mold sections 54 and 58 to close off the top of the hub mold cavity 46. Similarly, bottom caps or end walls 72 cooperate with the lower edge portions of the hub panel mold sections 54 and 58 to close off the bottom of the hub mold cavity 46 (see FIGS. 3 and 4). The mold sections 54 and 58 may be assembled in an inverted position on a suitable jig or fixture so that the relatively large diameter portion of the hub is disposed downwardly.

The outer ring portion 36 of the mold assembly 30 is constructed in much the same manner as is the hub portion 34 of the mold assembly 30. Thus, the outer ring portion 36 includes a circular array of ring panel mold sections 76 (FIG. 2) having inner surfaces of a configuration corresponding to the configuration of portions of an annular inner side surface 78 (FIG. 1) of the jet engine fan frame 20. A second circular array of ring panel mold sections 82 (FIG. 2) is disposed outwardly of and coaxial with the inner circular array of ring panel mold sections 76. The mold sections 82 have inner or mold surfaces which correspond to the configuration of portions of the annular outer surface 84 (FIG. 1) of the outer ring section 26 of the jet engine fan frame.

The upper and lower end portions of the outer ring mold sections 76 and 82 are interconnected by end caps or panels 88 and 90 (FIG. 3). The end caps 88 and 90 cooperate with the outer ring panel mold sections 76 and 82 to close the outer ring mold cavity 50 in the same manner as previously described in connection with the hub mold end walls or caps 68 and 72. The circular arrays of outer ring mold sections 76 and 82 circumscribe and are disposed in a coaxial relationship with the circular arrays of hub panel mold sections 54 and 58.

Both the hub portion 34 and outer ring portion 36 of the mold assembly 30 are formed by separate mold sections so that the surfaces which are utilized to form the molten metal in either the annular hub mold cavity 46 or the annular outer ring mold cavity 50 are exposed to view so that they can be inspected. Of course, defective mold sections would be either repaired or replaced. This results in high quality castings which need little or no repair. Since the jet engine fan frame 20 is integrally cast as one piece, the extensive welding and brazing steps currently used to make large jet engine fan frames are unnecessary.

The hub portion 34 and outer ring portion 36 of the illustrated mold assembly 30 are divided into six equal segments so that each of the hub panel sections 54 and 58 and outer ring panel sections 76 and 82 has an arcuate extent of 60°. The circular arrays of hub and outer ring mold sections are concentric with a common axis for the mold assembly 30. Of course, a greater or lesser number of mold sections of different arcuate extents could be utilized if desired.

Figure 6:
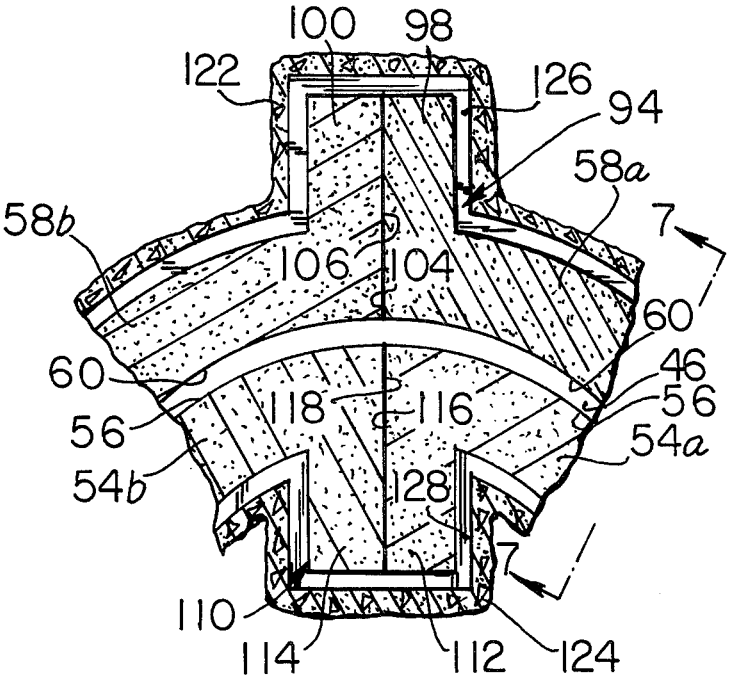
FIG. 6 is a fragmentary sectional view illustrating the manner in which sections of the mold assembly of FIG. 2 are interconnected at flange joints.

The hub and outer ring mold sections 54, 58, 76 and 82 are all interconnected at flange joints formed between circumferentially adjacent mold sections in the manner illustrated in FIG. 6. Thus, a pair of outer hub panel mold sections **58*a* and 58*b* are interconnected at a flange joint 94. The hub mold sections 58*a* and 58*b* have radially outwardly projecting flanges or end sections 98 and 100. The flanges 98 and 100 have flat radially extending joint surfaces 104 and 106 which are disposed in abutting engagement. Due to the tight flat abutting engagement between the surfaces 104 and 106, molten metal can not leak from the hub mold cavity 46 between the surfaces at the joint 94. The flange sections 98 and 100** are held in tight abutting engagement by a suitable cement (not shown) which is plastered about the outside of the flanges and is formed of a suitable ceramic material.

Similarly, a flange joint 110 is formed between the radially inner hub panel mold sections **54*a* and 54*b*. The hub panel mold sections 54*a* and 54*b* have a pair of radially inwardly projecting flanges 112 and 114. The flanges 112 and 114 have radially extending flat joint surfaces 116 and 118** disposed in abutting engagement with each other.

Although the flange joints between the mold sections 54*a*, 54*b*, 58*a* and 58*b* have been illustrated in FIG. 6, it should be understood that each of the panel sections has a radially projecting flange at each end. Therefore, the six hub panel mold sections 54 forming the radially inner circular array of hub panel mold sections are interconnected at six flange joints of a construction which is the same as the construction of the flange joint 110. The six radially outer hub panel mold sections 58 are each provided with a pair of radially outwardly projecting flanges, one at each circumferential end portion of the mold section, so that six flange joints of the same construction as the flange joint 94 are formed to interconnect the mold sections 58. It should be noted that the major side surfaces 60 on the hub panel mold sections 58 extend generally parallel to the major side surfaces 56 on the hub panel mold sections 54 to define the circular, relatively thin side wall of the jet engine fan frame hub 22 (see FIG. 1).

Figure 5:
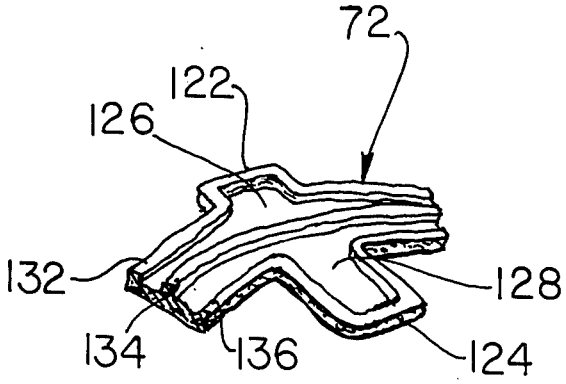
FIG. 5 is an illustration depicting the construction of an end wall utilized in the mold assembly of FIG. 2.

The flange joints 94 and 110 between the hub panel mold sections 58 and 54 are received in radially projecting areas 122 and 124 formed in central portions of the bottom end wall sections 72 (see FIGS. 5 and 6). Thus, the bottom end wall section 72 (FIG. 5) is provided with a pair of major bottom surfaces 126 and 128 which are engaged by the bottom or lower end portions of the hub mold sections 54 and 58. The bottom end wall sections 72 have an angular extent equal to the angular extent of one of the hub mold sections 54 or 58, that is 60° in the illustrated mold assembly. However, the six bottom wall sections 72 are angularly offset relative to the hub panel mold sections 54 and 58 so that the radially projecting portions 122 and 124 are located at the flange joints formed at the ends of the hub mold sections. This results in sealed end joints between adjacent bottom wall sections 72 being disposed midway between the flange joints interconnecting the hub panel mold sections 54 and 58.

Figure 7:
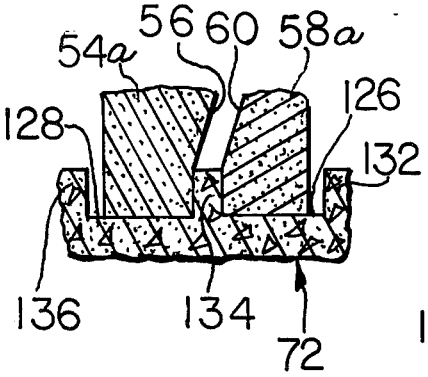
FIG. 7 is a sectional view taken generally along the line 7—7 of FIG. 6 and illustrating the relationship between a pair of mold sections and the end wall of FIG. 5.

The bottom end wall sections 72 advantageously have a generally E-shaped cross sectional configuration (see FIG. 7) to provide for sealing engagement between the end wall 72 and the surfaces of the hub panel mold sections 54 and 58. Thus, the flat bottom surfaces 126 and 128 between the upwardly projecting sides 132, 134 and 136 of the bottom end wall 72 abuttingly engage similarly shaped flat surfaces on the bottom of the hub mold section panels 54*a* and 58*a*. In addition, the lowermost portions of the major side surfaces 56 and 60 of the hub mold sections 54*a* and 58*a* are shaped to abuttingly engage the upwardly projecting side surfaces of the central wall 134 of the bottom end wall 72. The central wall 134 is accurately dimensioned to have a thickness corresponding to the desired distance between major side surfaces 56 and 60 at the bottom wall 72. Leakage of molten metal between the end wall 72 and mold sections 54 and 58 is prevented by sealing or plastering the bottom wall with a suitable ceramic material.

The six top end wall sections 68 for the hub portion 34 of the mold assembly 30 have substantially the same construction as do the six bottom end wall sections 72 (see FIGS. 2 and 3). Thus, each of the top end wall sections 60 is provided with radially projecting portions 140 (FIG. 2) at the top of the flange joints 94 and 110 between the hub panel mold sections 54 and 58. The radially projecting portions 140 cooperate with the top of the flange joints 94 and 110 in the same manner as do the radially projecting portions 122 and 124 of the bottom end wall portions 72.

The outer ring portions 36 of the mold assembly 30 has a construction which is generally similar to the construction of the hub portion 34 of the mold assembly. Thus, the outer ring section 36 includes two concentric circular arrays of six outer ring panel mold sections 76 and 82. Each of these mold sections is provided with a radially extending flange at each circumferentially opposite end of the mold section. The flanges on the outer ring mold sections 76 and 82 have the same construction and cooperate in the same manner as the flanges on the hub mold sections 54 and 58.

A plurality of upper and lower outer ring end wall sections 88 and 90 cooperate with the various mold sections in the same manner as previously described in connection with the hub portion 34 of the mold assembly. It should be noted that there are six upper end wall sections 88 and six lower end wall sections 90 each having the same angular extent, that is 60°, as the associated outer ring panel mold sections 76 and 82. However, the upper and lower end wall sections 88 and 90 are angularly offset relative to the outer ring panel mold sections 76 and 82 so that enlarged central portions 142 and 144 on the end wall sections 88 and 90 are disposed at the flange joints interconnecting the outer ring panel mold wall sections.

Figure 8:
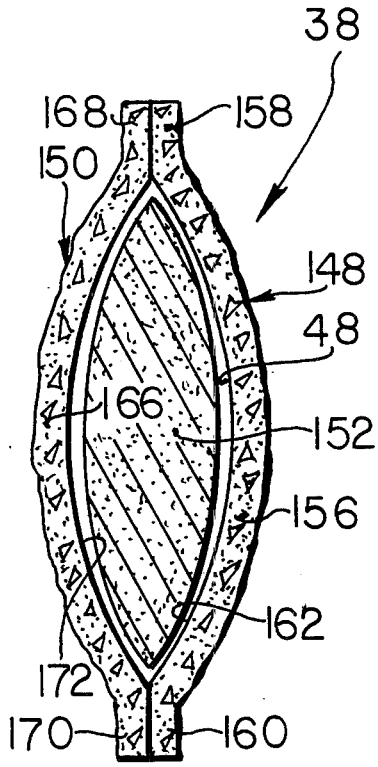
FIG. 8 is a sectional view, taken generally along the line 8—8 of FIG. 3, illustrating the configuration of a strut or vane section of the jet engine fan frame mold assembly.

The strut or vane portions 38 of the mold assembly 30 include a pair of separate mold sections 148 and 150 which cooperate with a core piece 152 to define the strut mold cavity 48 (see FIG. 8). The strut mold section 148 includes an arcuately curving body portion 156 and a pair of outwardly projecting flange portions 158 and 160. The inner surface 162 of the body portion 156 has a configuration corresponding to the configuration of one side of a strut or vane 24 of the jet engine fan frame 20. Similarly, the strut mold section 150 has an arcuate body portion 166 and a pair of outwardly projecting flanges 168 and 170. An arcuate inner surface 172 of the body portion 166 has a configuration corresponding to the configuration of the opposite side of a strut 24 of the jet engine fan frame 20. Although the two sides of the strut have been shown as having the same arcuate configuration, it is contemplated that the struts could be constructed to have different arcuate configurations. Of course, if this was done the inner surface 162 of the strut mold section 148 would have a different curvature than the inner surface 172 of the strut mold section 150.

The flanges 158 and 160 of the strut mold section 148 and the flanges 168 and 170 of the strut mold section 150 have flat inner surfaces which are disposed in abutting sealing engagement to prevent the leakage of molten metal from the strut mold cavity 48. The flanges are held against movement relative to each other by a suitable cement formed of a ceramic mold material. If desired, generally C-shaped caps, similar to the end wall 72, could be utilized in association with the flanges of the mold sections 148 and 150 to further hold them against movement relative to each other.

METHOD OF MAKING THE MOLD ASSEMBLY

The relatively large jet engine fan frame 20 is integrally formed of a one-piece construction by a precision investment casting or lost wax process. In this process the wax patterns having configurations corresponding to the configurations of the various mold sections are dipped in a slurry of ceramic mold material. After the wax patterns have been repetitively dipped and dried to form a covering of a desired thickness over the wax pattern, the covering and pattern are heated to a temperature sufficient to melt the wax pattern so that the covering over the wax pattern is free of the pattern. The mold could be dewaxed by many other methods including using solvents or microwave energy. In accordance with a feature of the present invention, at least some of the wet slurry coatings are wiped away from portions of the wax pattern so that the various mold sections can be easily separated when the wax pattern is melted. These mold sections are then assembled in a suitable jig to form the mold assembly 30 of FIG. 2.

Figure 9:
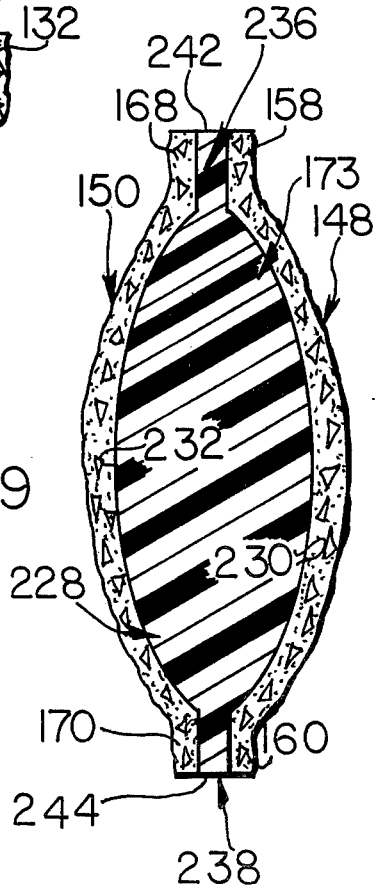
FIG. 9 is a sectional view depicting the relationship between a strut pattern and a covering of ceramic mold material.

A wax pattern 173 (see FIG. 9) is utilized in forming of the strut mold sections 148 and 150. A wax pattern 174 (FIG. 10) is utilized to form the hub panel mold sections 54 and 58 (FIG. 3) and the grating 42. Wax patterns of a configuration similar to the wax pattern 174 (FIG. 10) but without the grating, are utilized in the forming of the outer ring panel mold sections 76 and 82. It should be understood that the disposable patterns could be formed of a material other than wax, for example, a plastic pattern material such as polystyrene could be utilized, if desired.

To form the hub panel mold sections 54 and 58, the wax pattern 174 is repetitively dipped in a liquid slurry of ceramic mold material. Although many different types of slurry could be utilized, one illustrative slurry contains fused silica, zircon, or other refractory materials in combination with binders. Chemical binders such as ethyl silicate, sodium silicate and colloidal silica can be utilized. In addition, the slurry may contain suitable film formers such as alginates to control viscosity and wetting agents to control flow characteristics and pattern wetability.

In accordance with common practices, the initial slurry coating applied to the pattern contains a very finely divided refractory material to produce an accurate surface finish. A typical slurry for a first coat may contain approximately 29 percent colloidal silica suspension in the form of a 20 to 30 percent concentrate. Fused silica of a particle size of 325 mesh or smaller in an amount of 71 percent can be employed, together with less than one-tenth percent by weight of a wetting agent. Generally, the specific gravity of the slurry of ceramic mold material may be on the order of 1.75 to 1.80 and have a viscosity of 40 to 60 seconds when measured with a Number 5 Zahn cup at 75° to 85° F. After the application of the initial coating, the surface is stuccoed with refractory materials having particle sizes on the order of 60 to 200 mesh.

In accordance with well known procedures, each dip coating is dried before subsequent dipping. The pattern is repetitively dipped and dried enough times to build up a covering of ceramic mold material of a desired thickness. In one specific case the pattern was dipped fifteen times to build up a covering of a thickness of approximately 0.400 inches in order to prevent mold bulge. After the dewaxing, mold sections are fired at approximately 1900° F. for one hour to thoroughly cure the mold sections.

To provide the desired mold section configuration, the wax pattern 174 (see FIG. 10) includes a main wall or panel section 176 having an arcuate configuration with an angular extent of sixty degrees. The main wall section 176 includes a radially inner major side surface 178 having a configuration corresponding to the configuration of the radially inner surface 58 (FIG. 1) of the air frame hub 22. A radially outer major side surface 180 of the wall panel 176 has a configuration corresponding to the configuration of the outer surface 64 of the air frame hub 22. It should be noted that a projection 184 is provided on the inner side of the wall 176 to form an opening to an associated strut section. Similarly, a projection (not shown) is formed on the opposite side of the wall 176 to form a root or base to which to connect the strut mold sections.

Figure 10:
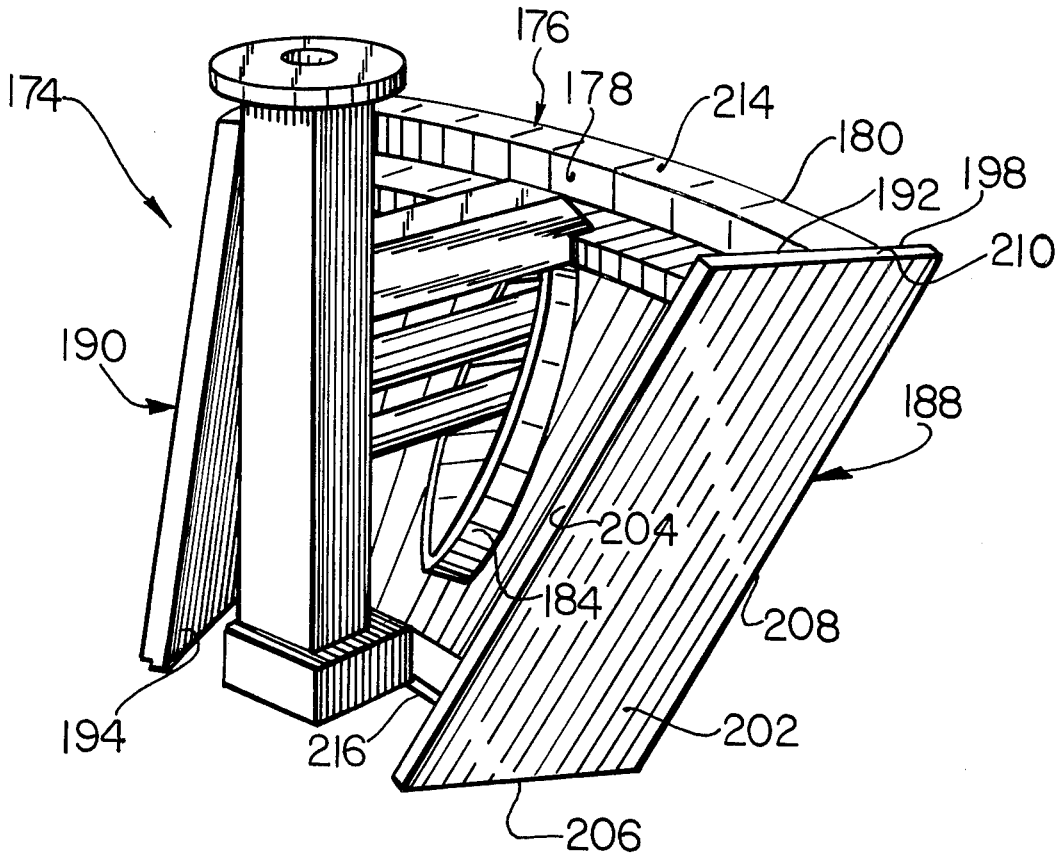
FIG. 10 is an illustration of a pattern utilized in forming hub sections of the mold assembly of FIG. 2.

Since each of the hub panel mold sections 54 and 58 are connected with adjacent mold sections at flange joints similar to the flange joints 94 and 110 of FIG. 6, pattern flange panels 188 and 190 (FIG. 10) are provided at opposite ends of the main wall 176. The pattern flange panels have inwardly facing side surface areas 192 and 194 which will accurately form the flat flange surfaces 116 and 118 (see FIG. 6) of the hub panel mold sections 54. Similarly, the flange panels 188 and 190 each have a pair of facing side surface areas 198 (only one of which is shown in FIG. 10) which accurately form the flat flange surfaces 104 and 106 (see FIG. 6) on the outer hub panel mold section 58. The flange panel 188 has a flat rectangular major outer side surface 202 which is connected with the major side surface areas 192 and 198 by a plurality of longitudinally extending edge or minor side surfaces 204, 206, 208 and 210. Although the configuration of only the flange panel 188 is fully illustrated in FIG. 10, it should be understood that the flange panel 190 is of the same configuration. It should be noted that the major side surface 202 and the minor side surfaces 204, 206, 208 and 210 of the pattern flange panel 188 do not correspond to any surfaces on the hub panel mold sections 54 and 58.

Since the major outer side surfaces 202 of the pattern flange patterns 188 and 190 do not correspond to portions of the hub mold sections, the ceramic coating on these outer side panels must be separated from the ceramic coatings on the wall surfaces 178 and 180 and the inner side surface areas 192, 194 and 198 of the flange panels. In addition, the ceramic mold material which was disposed over the inner major side surface 178 of the pattern wall 176 must be separated from the ceramic mold material which was disposed over the outer major side surface 180 of the mold wall 176.

In accordance with an important feature of the present invention the separating of the hardened ceramic mold material overlying the major outer side surfaces 202 of the pattern flange panels 188 and 190 from the hardened ceramic mold material overlying the major side surfaces 178 and 180 of the panel wall 176 is greatly facilitated by wiping away the wet dip coating on the minor side surfaces of the flange panels immediately after the pattern is dipped in the slurry of ceramic mold material. Similarly, the separating of the hardened ceramic mold material overlying the inner and outer major side surfaces 178 and 180 of the panel wall 176 is facilitated by wiping away the wet coating of ceramic mold material from upper and lower minor edge wall areas 214 and 216 extending between the upper and lower edges of the major side surfaces 178 and 180 of the wall panel 176.

Figure 12:
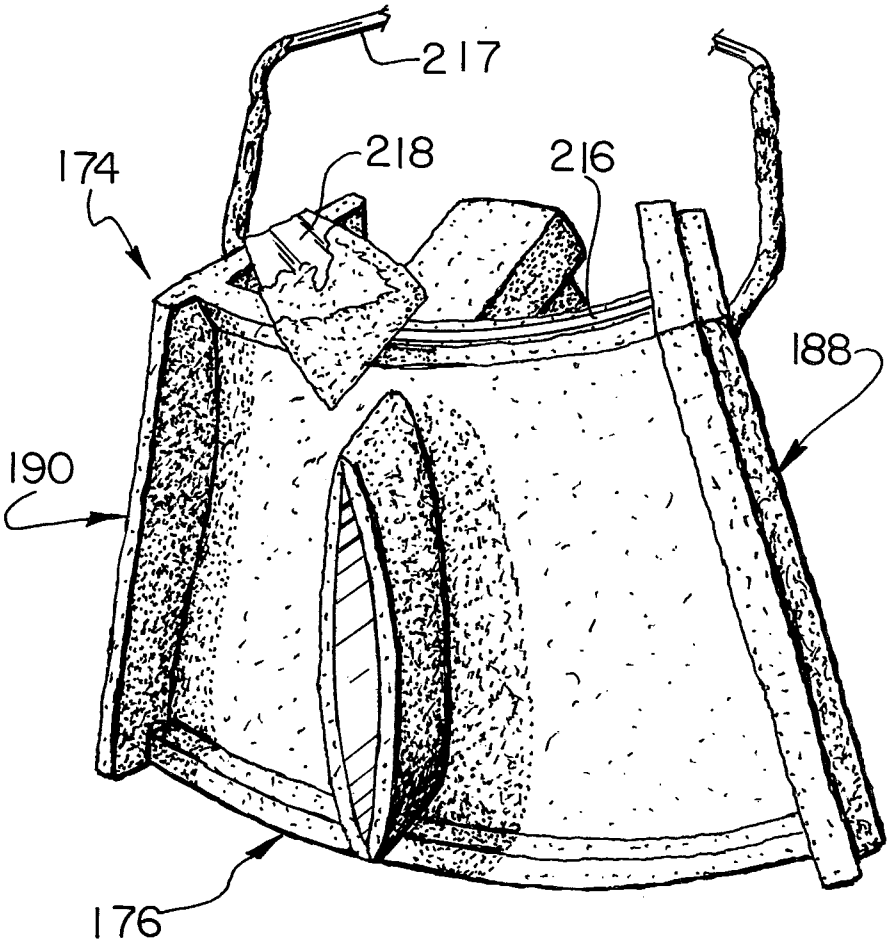
FIG. 12 is an illustration depicting the wiping of a wet coating of ceramic mold material from another surface of the pattern of FIG. 10.
Figure 11:
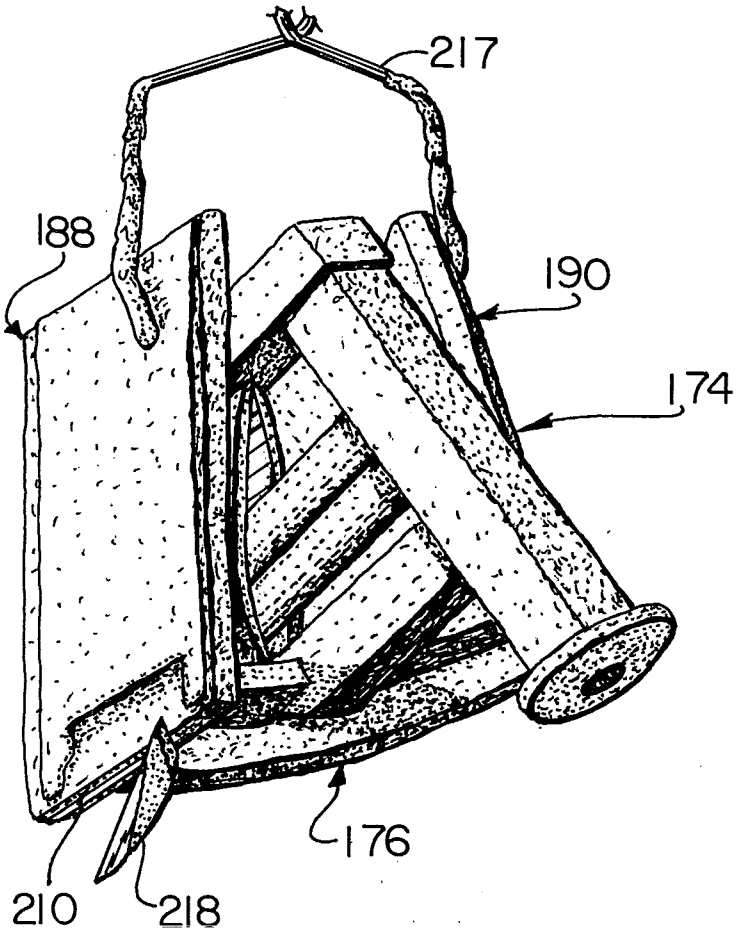
FIG. 11 is an illustration depicting the wiping of a coating of wet ceramic mold material from a surface of the pattern of FIG. 10 which is shown in an inverted position immediately after application of a dip coating to the pattern.

The manner in which the wiping away of the wet coating of ceramic mold material overlying the various minor side or edge surfaces of the pattern 174 is performed is illustrated in FIGS. 11 and 12. After the pattern 174 has been dipped in a liquid slurry of ceramic mold material, the pattern is manually supported above the liquid slurry tank by a support frame 217. A metal blade 218 is utilized to wipe away the slurry coating overlying the edge surface 210 of the pattern flange panel 188 (FIG. 11). Of course, the other minor surfaces 204, 206 and 208 of the pattern flange panel 188 are also wiped with the blade 218 to remove the wet coating of ceramic mold material overlying the surfaces. This separates the portion of the wet coating of ceramic mold material overlying the flange side surface 202 from the wet coating of ceramic mold material overlying the remainder of the pattern 174. The wet coating of ceramic material is then wiped from the minor sides of the pattern flange panel 190. This separates the portion of the coating of wet ceramic mold material overlying the major side surface of the flange 190 from the wet coating of ceramic mold material overlying the rest of the pattern 174.

The portions of the coating of wet ceramic mold material overlying the major side surfaces 178 and 180 are separated from each other. To this end, the wet coating of ceramic mold material overlying the minor side edge surface 216 is wiped away in the manner illustrated in FIG. 12. Finally, the top edge surface 214 of the pattern 174 is wiped with the blade 218 to complete the removal of the wet coating of ceramic mold material from the connecting surfaces of the pattern 174.

It should be noted that the foregoing wiping steps separated the wet coating of mold ceramic material overlying the pattern 174 into a plurality of discrete segments each of which is separated from an adjacent segment by a wiped area. In the illustrated embodiment of the invention two of the segments of wet dip coating correspond to two mold sections. Thus, the segment of wet dip coating overlying the inner major side surface 178 of the pattern corresponds to a hub mold section 54 and the segment of the wet dip coating overlying the major outer side surface 180 of the pattern wall 176 corresponds to the hub mold section 58. The segments of wet dip coating overlying the major outer side surfaces of the pattern flange panels 188 and 190 do not correspond to any of the mold sections.

As the pattern 174 is repetitively dipped, each wet coating is wiped in the manner previously explained and then dried. This results in the formation of a multi-layered covering of ceramic mold material on the pattern. This covering of ceramic mold material is sharply discontinuous at the areas overlying the wiped surfaces of the pattern. Thus the wiped minor flange surface 204 of the pattern flange panel 188 (see FIG. 13), a covering 218 of ceramic mold material overlying the flange panel side surface 202 is separated from a covering 220 overlying the inner side surface 198 of the inner flange panel flange 188 and the major side surface 178 of the pattern wall 176. When the wax pattern is disposed of by melting, the dried covering 218 of ceramic mold material overlying the pattern flange panel surface 202 is separated from the dried covering 220 of ceramic mold material overlying the pattern flange panel surface 198 and side wall surface 178. Similarly, a covering 224 of dried ceramic mold material overlying the pattern flange surface 198 and the outer pattern wall surface 180 is separated from the covering 218 overlying the major outer surface 202 of the pattern flange panel.

Figure 13:
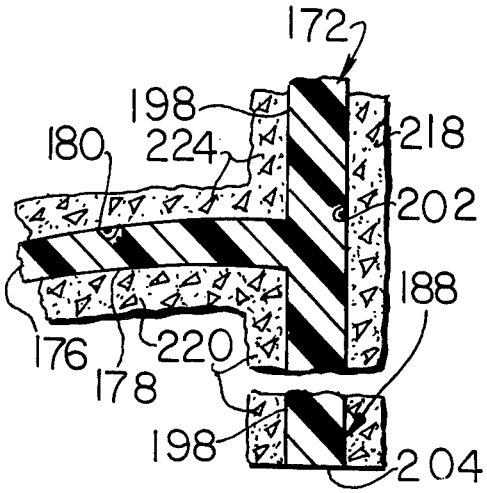
FIG. 13 is a fragmentary sectional view illustrating the relationship between a covering ceramic mold material on the pattern of FIG. 10 and a wiped surface.

If the wiping steps had not been performed, the covering of ceramic mold material would have completely enclosed the pattern and would not have been discontinuous in the manner illustrated in FIG. 13. Therefore, when the pattern was subsequently melted and the ceramic mold material fired, all of the sections of the ceramic mold material would be firmly interconnected and the hardened covering would have to be cut or abraded away in a troublesome and time consuming manner. By performing the wiping steps, the troublesome and time consuming cutting or abrading away of the hardened ceramic mold material is eliminated with consequent savings in the cost of producing the mold assembly 30.

All of the coatings of wet ceramic mold material can be wiped away from the parting or separating surfaces of the pattern to expose the pattern surfaces in the wiped away areas as illustrated in FIG. 13. However, it has been found to be advantageous to omit the wiping step after the initial dip coating of ceramic material is applied to the pattern. This initial dip coating of ceramic mold material is very fine and, after drying, forms a barrier to seal and protect the corners of the pattern during subsequent dip coatings and wipings. It should be understood that although the wiping step is advantageously omitted after the initial coating is applied to the pattern, the wiping step is performed after each of the subsequent dip coatings. Thus, after the initial dip coating has been dried and the pattern is dipped for a second time, the wet coating of ceramic mold material overlying the various edges or minor surfaces of the pattern is wiped away in the manner illustrated in FIGS. 11 and 12. When the pattern is subsequently melted and the ceramic mold material fired, an extremely thin delicate shell resulting from the initial dip coating extends between the built up relatively heavy sections of ceramic mold material. This thin connecting coating is easily broken to separate the various mold sections and does not require a time consuming cutting or abrading operation. It should be noted that the initial dip coating of ceramic mold material is not stuccoed and is very fine so that it can be readily broken.

It should be noted that the flat flange joint surfaces 104, 106, 116 and 118 (see FIG. 6) are accurately formed by side surfaces 192, 194 and 198 (FIG. 10) of the pattern flanges 188 and 190. By accurately forming the flat flange joint surfaces 104, 106, 116 and 118, a fluid tight seal can be readily obtained at the various flange joints.

The strut mold pattern 173 (FIG. 9) is dipped in a slurry of ceramic material and wiped in the same manner as previously explained in conjunction with the hub mold pattern 174. The strut mold pattern 173 has a body 228 with a pair of arcuate outer side surfaces 230 and 232. The outer side surface 230 of the strut pattern 173 has the same configuration as one of the side surfaces of a jet engine fan frame strut 24. The opposite side surface 232 of a pattern body 228 has a configuration corresponding to the configuration of the opposite side of a strut 24.

Although the two side surfaces 230 and 232 of the strut pattern body 228 have configurations corresponding to the configuration of opposite sides of a strut 24, the two side surfaces 230 and 232 of the pattern body 228 are spaced further apart than are the opposite side surfaces of a strut. The spacing between the opposite side surfaces 230 and 232 of the pattern body 228 exceeds the spacing between the opposite side surfaces of the strut 24 by the thickness of a pair of flange sections 236 and 238 which extend outwardly from the pattern body 228. The flange sections 236 and 238 accurately form flat surfaces on the flange portion 158, 160, 168 and 170 of the mold sections 148 and 150. When the pattern 173 is disposed of by melting, the separate strut mold sections 148 and 150 can be connected together with the flange surfaces in abutting engagement in the manner illustrated in FIG. 8. When the mold sections are interconnected in this manner, the inner side surfaces 162 and 172 of the mold sections 148 and 150 are spaced apart by a distance which is equal to the spacing between the opposite sides of the strut 24.

During the forming of the strut mold sections 148 and 150, the longitudinally extending minor edge surfaces 242 and 244 of the flanges 236 and 238 are wiped to remove the portion of the wet coating of ceramic mold material overlying these surfaces. This results in the coating of wet ceramic mold material being divided into two segments, that is the segment overlying the outer side surface 230 of the strut pattern body 228 and the segment overlying the outer side surface 232 of the strut pattern body. Although in the illustration in FIG. 9 each of the wet dip coatings of ceramic mold material was wiped from the flange surfaces 242 and 244 to expose these surfaces, it is believed to be advantageous to omit the wiping of the initial dip coating so that a protective shell is formed over the outer flange surfaces after the initial dip coating has been dried and prior to wiping of the subsequent coatings.

Although only the strut pattern 173 and hub section pattern 174 have been illustrated in the drawings, it should be understood that outer ring section patterns and end wall patterns are also utilized. The outer ring section patterns have a main wall section with an outer surface corresponding to the configuration of the outer side surface 84 (FIG. 1) of the outer ring 26 of the jet engine fan frame 20 and an inner side surface corresponding to the configuration of the inner side surface 78 of the outer ring of the jet engine fan frame. Since the mold sections 76 and 82 for the outer ring portion 36 of the mold assembly 30 are interconnected at flange joints (see FIG. 2) in the same manner as are the hub mold sections, the patterns for the outer ring sections are provided with flange panels similar to the flange panels 188 and 190 utilized in association with the hub pattern. Of course, the minor side or outer edge surfaces of the outer ring patterns are wiped in the same manner as previously explained in connection with the hub patterns.

Figure 14:
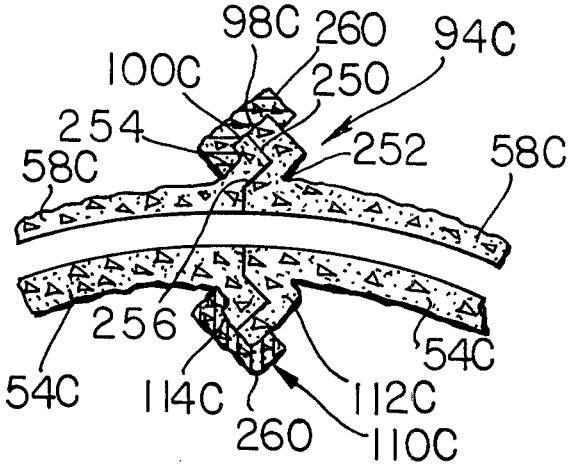
FIG. 14 is a fragmentary sectional view illustrating the construction of generally Z-shaped joints utilized in connecting mold sections of a second embodiment of the invention.
Figure 15:
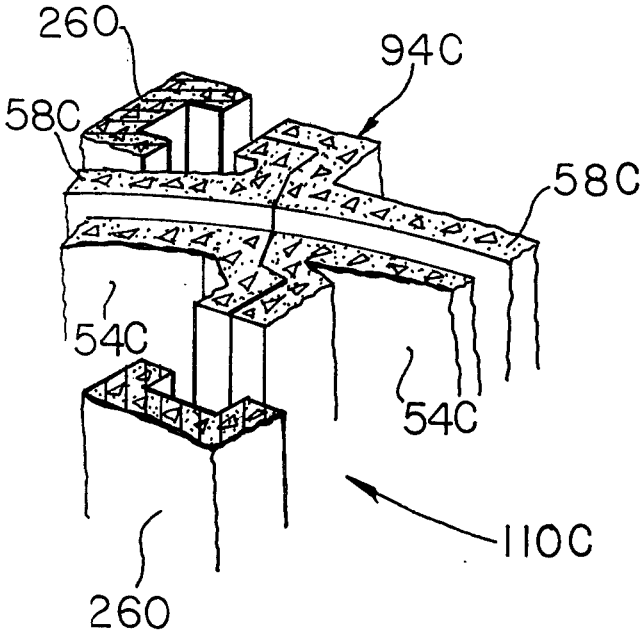
FIG. 15 is a fragmentary illustration depicting the relationship between the Z-type flange joints of FIG. 14 and cap members which are utilized to hold the mold sections against movement.

In the embodiment of the invention illustrated in FIGS. 1–13 the flange surfaces between the various mold sections are flat so that the mold sections must be positioned relative to each other by suitable locating pins on a jig. However, in the embodiment of the invention illustrated in FIGS. 14 and 15 the flange surfaces are not flat and are utilized to position the adjacent mold sections relative to each other. Since the embodiment of the invention illustrated in FIGS. 14 and 15 is generally similar to the embodiment illustrated in FIGS. 1–13, similar numerals will be utilized to designate similar components with the suffix "*c*" added to the numerals in the embodiment of the invention illustrated in FIGS. 14 and 15 to avoid confusion.

Flange joints 94*c* and 110*c* between mold sections 58*c* and 54*c* (see FIG. 14) are formed by flanges 98*c*, 100*c*, 112*c* and 114*c* projecting radially out from the main walls of the mold sections. Each of the flanges has an accurately formed generally Z-shaped surface. Thus, the flange 98*c* has a surface 250 which extends at an angle to the surface 252 of the flange. Similarly, the flange 100*c* has a surface 254 which extends at an angle to a second flange surface 256. The angular intersection between the flange surfaces 250 and 252 cooperates with the angular intersection between the flange surfaces 254 and 256 to position the adjacent mold sections 58*c* relative to each other. An end cap 260 is advantageously utilized to hold the flange surfaces in tight abutting engagement. It is believed that it will be apparent that the flange joint 110*c* has the same construction as the flange joint 94*c* and is effective to position the adjacent mold sections 54*c* relative to each other. In addition to locating the adjacent mold sections relative to each other, the generally Z-shaped flange surfaces may be preferred under certain circumstances due to the sealing action obtained by the irregularly shaped joint.

In view of the foregoing description it can be seen that the present invention provides a new and improved method of making an improved mold assembly 30 which is utilized in the forming of a one-piece cast turbine engine component, that is the jet engine fan frame 20. The mold assembly 30 includes a plurality of relatively small mold sections or segments 54, 58, 76, 82, 148 and 150 which are interconnected to form a relatively large jet engine fan frame mold. Since relatively small mold sections are interconnected to form the large mold assembly 30, relatively small wax patterns can be utilized to accurately form each of the mold sections with a minimum of pattern deflection. Since the surfaces of each of the separate mold sections can be inspected and any defects repaired before they are interconnected in the mold assembly 30, the resulting casting will have a minimum of defects. The various mold sections may advantageously be interconnected at flange joints 94 and 110 which may have the generally Z-shaped cross sectional configurations as illustrated in FIGS. 14 and 15.

To form the mold sections or segments, a relatively small wax pattern, such as the pattern 174, having a surface with a configuration corresponding to the desired shape of a portion of the mold surface is repetitively dipped in a slurry of ceramic mold material. Each time the wax pattern is dipped, the resulting coating of wet ceramic mold material is dried so that a covering of ceramic mold material is built up on the wax pattern. In accordance with one feature of the present invention, the portion of the wet ceramic coating overlying the pattern surface having a shape corresponding to the desired shape of a portion of the mold section is separated from the remainder of the wet ceramic coating by wiping operation. This wiping operation removes the wet ceramic coating in an area overlying a portion of the wax pattern which extends around the portion of the wax pattern having the desired mold surface configuration.

If the pattern is wiped after each dipping step, the wax pattern is exposed in an area which circumscribes the portion of the surface of the pattern having the desired mold surface configuration. However, it is contemplated that the wax pattern may not be wiped after each of the dipping steps so that the pattern will have a relatively thick covering 218, 220 and 224 of ceramic mold material overyling the surface area of the pattern corresponding to the desired mold section configuration while a relatively thin covering of ceramic material is formed over an interconnecting surface, such as the surface 204 (FIG. 13). This relatively thin covering is obtained by omitting the wiping step after the initial dipping step so that an initial covering is formed over the entire wax pattern. After the next subsequent dipping step, the wet coating of ceramic mold material is wiped away from the area overlying the parting or separating surfaces, such as the surface 204 of FIG. 13.

Once a covering of the desired thickness has been built up over the portion of the wax pattern having configuration corresponding to the desired mold section configuration, the pattern is destroyed by a melting operation. After the pattern has been melted a separate mold section having a desired configuration is released. After the required number of mold sections have been formed in this manner and inspected for defects, the mold sections are interconnected to form the mold assembly 30 for casting a relatively large metal part. Since the mold assembly 30 is made up of relatively small sections, relatively small patterns are utilized so that pattern breakage and flexing is minimized during the dipping of the pattern to thereby provide for superior dimensional control.

Although the mold assembly 30 and the method by which it is constructed have been described herein in association with a particular turbine engine component, that is the jet engine fan frame 20, the present invention can be utilized to form other items. Although it is believed that the present invention is advantageously utilized in the formation of large castings, the invention can be utilized in the formation of small castings. Among the relatively large castings which can advantageously be made utilizing the present invention are various turbine engine components including diffuser cases, nozzle rings, vane assemblies, and bearing supports.

We claim:

1. A method of making a mold assembly for use in forming a cast product, said method comprising the steps of providing at least one pattern having a plurality of surface areas including a first surface area having a configuration similar to a surface area of the cast product and a second surface area which does not correspond to any surface area of the cast product, making a plurality of mold sections, and interconnecting said plurality of mold sections to form the mold assembly, said step of making a plurality of mold sections including the steps of applying a wet coating of a liquid ceramic mold material over the first and second surface areas of the pattern, removing at least a major portion of the wet coating of ceramic mold material overlying the second surface area of the pattern, at least partially drying the wet coating of ceramic mold material after performing said step of removing the wet coating of ceramic mold material overlying the second surface area of the pattern, and separating the pattern from the dried coating of ceramic mold material to provide a mold section formed of ceramic material and having a surface area with a configuration corresponding to the configuration of the first surface area of the pattern.

2. A method as set forth in claim 1 wherein the pattern has a third surface area having a configuration corresponding to a surface area of the cast product, the first and third surface areas of the pattern being interconnected at least in part by the second surface area of the pattern, said step of removing the wet coating of ceramic mold material overlying the second surface area of the pattern being effective to divide the wet coating of ceramic mold material into at least one portion overlying the first surface area of the pattern and another portion which overlies the third surface area of the pattern and is spaced apart from the one portion of the wet coating of ceramic mold material.

3. A method as set forth in claim 1 further including the step of applying an initial wet covering of ceramic mold material over the first and second surface areas of the pattern, at least partially drying the initial wet covering of ceramic mold material to form an initial layer of ceramic mold material overlying the first and second surface areas of the pattern, said step of applying a wet coating of ceramic mold material over the first and second surface areas of the pattern including the step of applying a wet coating of ceramic mold material to the initial layer of ceramic mold material, said step of removing the wet coating of ceramic mold material overlying the second surface area of the pattern including the step of removing wet ceramic mold material from the portion of the initial layer of ceramic mold material overlying the second surface area of the mold.

4. A method as set forth in claim 1 wherein said step of removing the wet coating of ceramic mold material overlying the second surface area of the pattern includes the step of removing wet ceramic from the second surface area of the pattern to at least partially uncover the second surface area of the pattern.

5. A method as set forth in claim 1 wherein said step of applying a wet coating of a liquid ceramic material over the first and second surface areas of the pattern includes the step of dipping the pattern in a body of liquid ceramic material, said step of removing the wet coating of ceramic mold material overlying the second surface area of the pattern includes the step of wiping away the portion of the wet coating of ceramic mold material overlying the second surface area.

6. A method of making a mold assembly for use in casting a one-piece turbine engine component having a circular inner wall and a circular outer wall interconnected by a plurality of radially extending struts, said method comprising the steps of providing a plurality of disposable inner wall section patterns, a plurality of disposable outer wall section patterns and a plurality of disposable strut section patterns, applying a coating of a ceramic mold material to each of the patterns, forming separate inner wall, outer wall and strut mold sections made of ceramic mold material by disposing of the patterns after performing said step of applying a coating of ceramic mold material to each of the patterns, said step of forming separate inner wall, outer wall and strut mold sections includes the steps of forming a first plurality of inner wall mold sections each of which has a surface with a configuration corresponding to the configuration of a portion of a circular radially inner surface area of the inner wall of the turbine engine component, forming a second plurality of inner wall mold sections each of which has a surface with a configuration corresponding to the configuration of a portion of a circular radially outer surface area of the inner wall of the turbine engine component, forming a first plurality of outer wall mold sections each of which has a surface with a configuration corresponding to the configuration of a portion of a circular radially inner surface area of the outer wall of the turbine engine component, forming a second plurality of outer wall mold sections each of which has a surface with a configuration corresponding to the configuration of a portion of a circular radially outer surface area of the outer wall of the turbine engine component, forming a first plurality of strut mold sections each of which has a configuration corresponding to the configuration of at least a portion of one side of a strut, and forming a second plurality of strut mold sections each of which has a configuration corresponding to the configuration of at least a portion of a side of a strut opposite from said one side, said method further including the steps of interconnecting the first plurality of inner wall mold sections in a first circular array of inner wall mold sections, interconnecting the second plurality of inner wall mold sections in a second circular array of inner wall mold sections which cooperates with the first circular array of inner wall mold sections to at least partially define a mold cavity having a configuration corresponding to the configuration of the inner wall of the turbine engine component, interconnecting the first plurality of outer wall mold sections in a first circular array of outer wall mold sections, interconnecting the second plurality of outer wall mold sections in a second circular array of outer wall mold sections which cooperates with the first circular array of outer wall mold sections to at least partially define a mold cavity having a configuration corresponding to the configuration of the outer wall of the turbine engine component, interconnecting each of the first plurality of strut mold sections with one of the second plurality of strut mold sections to at least partially define a plurality of strut section mold cavities having a configuration corresponding to the configurations of the struts of the turbine engine component, and interconnecting the strut mold sections with the first circular array of outer wall mold sections and with the second circular array of inner wall mold sections.

7. A method as set forth in claim 6 wherein each of the inner wall section patterns has a first side surface with a configuration corresponding to the configuration of a portion of the circular radially inner surface area of the inner wall of the turbine engine component and a second side surface with a configuration corresponding to the configuration of the circular radially outer surface area of the inner wall of the turbine engine component, said step of applying a coating of ceramic mold material to each of the patterns including the step of applying a wet coating of a ceramic mold material to each of the inner wall section patterns and at least partially drying the wet coating of ceramic mold material prior to disposing of the inner wall section patterns, said method further including the step of removing at least a major portion of the wet coating of ceramic mold material overlying areas of each of the inner wall section patterns which are disposed in an interconnecting relationship with the first and second side surfaces of the inner wall section patterns.

8. A method as set forth in claim 6 wherein each of the outer wall section patterns has a first side surface with a configuration corresponding to the configuration of a portion of the circular radially inner surface area of the outer wall of the turbine engine component and a second side surface with a configuration corresponding to the configuration of a portion of the circular radially outer surface area of the outer wall of the turbine engine component, said step of applying a coating of ceramic mold material to each of the patterns including the step of applying a wet coating of ceramic mold material to each of the outer wall section patterns and at least partially drying the wet coatings of ceramic mold material prior to disposing of the outer wall section patterns, said method further including the step of removing at least a major portion of the wet coating of ceramic mold material overlying areas of each of the outer wall section patterns which are disposed in an interconnecting relationship with the first and second side surfaces of the outer wall section patterns.

9. A method as set forth in claim 6 wherein each of the strut section patterns has a first side surface with a configuration corresponding to the configuration of at least a portion of a first side of a strut and a second side surface with a configuration corresponding to the configuration of at least a portion of a second side of a strut, said step of applying a coating of ceramic mold material to each of the patterns including the step of applying a wet coating of ceramic mold material to each of the strut section patterns and at least partially drying the wet coatings of ceramic mold material prior to disposing of the strut section patterns, said method further including the step of removing at least a major portion of wet coating of ceramic mold material overlying areas of each of the strut section patterns which are disposed in an interconnecting relationship with the first and second side surfaces of the strut section patterns.

10. A method as set forth in claim 6 wherein each of the inner wall section patterns has an outwardly projecting flange portion, said step of applying a coating of ceramic mold material to each of the patterns including the step of applying a coating of ceramic mold material to the flange portion of each of said inner wall section patterns, said steps of forming first and second pluralities of inner wall mold sections each including the steps of forming inner wall mold sections having projecting flange surfaces of a configuration corresponding to at least a part of the flange portions of the inner wall section patterns, said steps of interconnecting the first plurality of inner wall mold sections in a first circular array and interconnecting the second plurality of inner mold sections in a second circular array including the step of positioning flange surfaces on adjacent inner wall mold sections in abutting engagement.

11. A method as set forth in claim 6 wherein each of said outer wall section patterns has an outwardly projecting flange portion, said step of applying a coating of ceramic mold material to each of the patterns including the step of applying a coating of ceramic mold material to the flange portions of each of said outer wall section patterns, said steps of forming first and second pluralities of outer wall mold sections each including the steps of forming outer wall mold sections having projecting flange surfaces of a configuration corresponding to at least a part of the flange portions of the outer wall section patterns, said steps of interconnecting the first plurality of outer wall mold sections in a first circular array and interconnecting the second plurality of outer wall mold sections in a second circular array including the step of positioning flange surfaces on adjacent outer wall mold sections in abutting engagement.

12. A method as set forth in claim 6 wherein each of said strut section patterns has an outwardly projecting flange portion, said step of applying a coating of ceramic mold material to each of the patterns including the step of applying a coating of a ceramic mold material to the flange portion of each of said strut section patterns, said steps of forming first and second pluralities of strut mold sections including the steps of forming strut mold sections having projecting flange surfaces of a configuration corresponding to at least a part of the flange portions of the strut section patterns, said step of interconnecting each one of the first plurality of strut mold sections with one of the second plurality strut mold sections including the step of placing flange surfaces on strut mold sections in abutting engagement.

13. A method as set forth in claim 6 wherein said steps of interconnecting the first plurality of inner wall mold sections in a first circular array of inner wall mold sections and interconnecting the second plurality of inner wall mold sections in a second circular array of inner wall mold sections includes the steps of interconnecting the first and second pluralities of inner wall mold sections with at least one axial end portion of the first circular array of inner wall mold sections spaced apart from at least one axial end portion of the second circular array of inner wall mold sections, said method further including the steps of providing a plurality of mold end wall sections and connecting the plurality of mold end wall sections with the spaced apart axial end portions of the first and second circular arrays of inner wall mold sections.

14. A method as set forth in claim 13 wherein said step of interconnecting the first plurality of inner wall mold sections in a first circular array of inner wall mold sections includes the step of interconnecting the first plurality of inner wall mold sections at a first plurality of joints which extend between opposite axial end portions of the first circular array of inner wall mold sections, said step of interconnecting the second plurality of inner wall mold sections in a second circular array of inner wall mold sections including the step of interconnecting the second plurality of inner wall mold sections at a second plurality of joints which extend between opposite axial end portions of the second circular array of inner wall mold sections, said step of connecting the plurality of mold end wall sections with the spaced apart axial end portions of the first and second circular arrays of inner wall mold sections including the step of connecting the plurality of mold end wall sections with the first and second annular arrays of inner wall mold sections with portions of the mold end wall sections extending across the first and second pluralities of joints.

15. A method as set forth in claim 6 wherein said steps of interconnecting the first plurality of outer wall mold sections in a first circular array of outer wall mold sections and interconnecting the second plurality of outer wall mold sections in a second circular array of outer wall mold sections includes the steps of interconnecting the first and second pluralities of outer wall mold sections with at least one axial end portion of the first circular array of outer wall mold sections spaced apart from at least one axial end portion of the second circular array of outer wall mold sections, said method further including the steps of providing a plurality of mold end wall sections and connecting the plurality of mold end wall sections with the spaced apart axial end portions of the first and second circular arrays of outer wall mold sections.

16. A method as set forth in claim 15 wherein said step of interconnecting the first plurality of outer wall mold sections in a first circular array of outer wall mold sections includes the step of interconnecting the first plurality of outer wall mold sections at a first plurality of joints which extend between opposite axial end portions of the first circular array of outer wall mold sections, said step of interconnecting the second plurality of outer wall mold sections in a second circular array of outer wall mold sections including the step of interconnecting the second plurality of outer wall mold sections at a second plurality of joints which extend between opposite axial end portions of the second circular array of outer wall mold sections, said step of connecting the plurality of mold end wall sections with the spaced apart axial end portions of the first and second circular arrays of outer wall mold sections including the step of connecting the plurality of mold end wall sections with the first and second annular arrays of outer wall mold sections with portions of the mold end wall sections extending across the first and second pluralities of joints.

17. A method of making a mold section for use in forming a cast product, said method comprising the steps of providing a pattern having at least a pair of pattern surface areas at least one of which has a configuration corresponding to the configuration of a surface of the cast product, applying a wet coating of liquid ceramic mold material over at least a portion of the pattern which includes the pair of pattern surface areas, forming a discontinuity in the wet coating of ceramic mold material to separate the portion of the wet coating of ceramic mold material overlying one of the pattern surface areas from the portion of the wet coating of ceramic mold material overlying the other pattern surface area, said step of forming a discontinuity in the wet coating of ceramic mold material including the step of wiping away a portion of the wet coating of ceramic mold material to divide the wet coating of ceramic mold material into at least a first segment which extends over one pattern surface area and a second segment which is spaced apart from the first segment and extends over the other pattern surface area, at least partially drying the wet coating of ceramic mold material after performing said wiping step, and removing the segments of the dried coating of ceramic mold material from the pattern to provide a mold section.

18. A method as set forth in claim 17 wherein said step of wiping away a portion of the wet coating of ceramic mold material includes the step of exposing a portion of the surface of the pattern in the area where the wet coating of ceramic mold material was wiped away.

19. A method as set forth in claim 17 further including the step of providing an initial covering of ceramic mold material over the pattern prior to performing said step of applying a wet coating of ceramic mold material over the pattern, said step applying a wet coating of ceramic mold material over the pattern includes the step of applying the wet coating of ceramic mold material directly to the initial covering, said step of wiping away a portion of the wet coating of ceramic mold material including the step exposing a portion of the initial covering of ceramic mold material in the area where the wet coating of ceramic mold material was wiped away.

20. A method of making a plurality of mold sections for use in forming a cast product having at least a pair of side surfaces, said method comprising the steps by providing a pattern having at least a pair of spaced apart pattern surfaces with configurations corresponding to the configurations of the side surfaces of the cast product, applying a wet coating of liquid ceramic mold material over at least a portion of the pattern which includes the spaced apart pattern surfaces, forming a discontinuity in the wet coating of ceramic mold material to separate the portion of the wet coating of ceramic mold material overlying one of the pattern surfaces from the portion of the wet coating of ceramic mold material overlying the other pattern surface, said step of forming a discontinuity in the wet coating of ceramic mold material including the step of wiping away a portion of the wet coating of ceramic mold material to divide the wet coating of ceramic mold material into at least a first segment which extends over the one pattern surface and a second segment which is spaced apart from the first segment and extends over the other pattern surface, at least partially drying the wet coating of ceramic mold material after performing said wiping step, and removing the segments of the dried coating of ceramic mold material from over the pattern surfaces to provide a pair of mold sections.

21. A mold assembly for use in forming a one-piece turbine engine component having a circular inner wall and a circular outer wall interconnected by a plurality of radially extending struts, said mold assembly comprising a first plurality of inner wall mold sections disposed in a first circular array, each of said first plurality of inner wall mold sections having a major side surface with a configuration corresponding to the configuration of at least a portion of a radially inner side surface of the inner wall of the turbine engine component, a second plurality of inner wall mold sections disposed in a second circular array circumscribing at least a portion of said first circular array of inner wall mold sections, each of said second plurality of inner wall mold sections having a major side surface with a configuration corresponding to the configuration of at least a portion of a radially outer side surface of the inner wall of the turbine engine component, means for interconnecting said first and second pluralities of inner wall mold sections to at least partially define a first annular mold cavity having a configuration corresponding to the configuration of the inner wall of the turbine engine component, a first plurality of outer wall mold sections disposed in a first circular array of outer wall mold sections circumscribing said first and second circular arrays of inner wall mold sections, each of said first plurality of outer wall mold sections having a major side surface with a configuration corresponding to the configuration of at least a portion of a radially inner side surface of the outer wall of the turbine engine component, a second plurality of outer wall mold sections disposed in a second circular array of outer wall mold sections and circumscribing at least a portion of said first circular array of outer wall mold sections, each of said second plurality of outer wall mold sections having a major side surface with a configuration corresponding to the configuration of at least a portion of a radially outer side surface of the outer wall of the turbine engine component, means for interconnecting said first and second pluralities of outer wall mold sections to at least partially define a second annular mold cavity having a configuration corresponding to the configuration of the outer wall of the turbine engine component, a first plurality of strut mold sections each of which has a configuration corresponding to the configuration of at least a portion of a first side of a strut of the turbine engine component, a second plurality of strut mold sections each of which has a configuration corresponding to the configuration of at least a portion of a second side of a strut of the turbine engine component, means for interconnecting said first and second pluralities of strut mold sections to at least partially define a plurality of strut mold cavities having a configuration corresponding to the configuration of the struts of the turbine engine component, means for connecting said strut mold sections with said second circular array of inner wall mold sections with said first annular mold cavity connected in fluid communication with each of said strut mold cavities, and means for connecting said strut mold sections with said first circular array of outer wall mold sections with said second annular mold cavity connected in fluid communication with each of said strut mold cavities.

22. A mold assembly as set forth in claim 21 further including a first plurality of flange joints interconnecting said first plurality of inner wall mold sections, a second plurality of flange joints interconnecting said second plurality of inner wall mold sections, each of said flange joints having a generally Z-shaped cross sectional configuration in a plane extending radially through said first annular mold cavity.

23. A mold assembly as set forth in claim 21 further including a first plurality of flange joints interconnecting said first plurality of outer wall mold sections, a second plurality of flange joints interconnecting said second plurality of outer wall mold sections, each of said flange joints having a generally Z-shaped cross sectional configuration in a plane extending radially through said second annular mold cavity.

24. A mold assembly as set forth in claim 21 wherein said first plurality of inner wall mold sections have arcuate outer end portions disposed in a circular array, said second plurality of inner mold sections having arcuate outer end portions disposed in a circular array and spaced apart from the outer end portions of said first plurality of inner wall mold sections, said mold assembly further including a plurality of arcuate mold end wall sections disposed in a circular array and extending between the arcuate outer end portions of said first and second pluralities of inner wall mold sections to close one axially outer end of said first annular mold cavity.

25. A mold assembly as set forth in claim 21 wherein said first plurality of outer wall mold sections have arcuate outer end portions disposed in a circular array, said second plurality of outer wall mold sections having arcuate outer end portions disposed in a circular array and spaced apart from the outer end portions of said first plurality of outer wall mold sections, said mold assembly further including a plurality of mold end wall sections disposed in a circular array and extending between the outer end portions of said first and second pluralities of outer wall mold sections to close one axially outer end of said second annular mold cavity.

26. A method of making a mold assembly for use in forming a cast product having opposite side surfaces, said method comprising the steps of providing a disposable pattern having a body with an outwardly extending flange, the pattern body having opposite side surfaces which have configurations corresponding to the configurations of the side surfaces of the cast product and are spaced further apart than the side surfaces of the cast product, said method further including the steps of coating at least the body and flange of the pattern with a liquid ceramic mold material, wiping away the wet coating overlying a portion of the flange, drying the wet coating after performing said wiping step, repeating the coating, wiping, and drying steps until a covering of ceramic mold material of a desired thickness has been built up on at least part of the pattern, providing a pair of separate mold sections which have mold surfaces with configurations corresponding to the configurations of the side surfaces of the cast product, said step of providing a pair of separate mold sections including the step of destroying the disposable pattern, and thereafter locating the mold surfaces on the separate mold sections in the same spatial relationship as the opposite side surfaces on the cast product by placing in abutting engagement surfaces on the mold sections which were previously disposed on opposite sides of the pattern flange.

27. A method of making a mold assembly for use in forming a cast product having opposite side surfaces, said method comprising the steps of providing a disposable pattern having a body with an outwardly extending flange, the pattern body having opposite side surfaces which have configurations corresponding to the configurations of the side surfaces of the cast product and are spaced further apart than the side surfaces of the cast product, said method further including the steps of coating at least the body and flange of the pattern with a liquid ceramic mold material, drying the coating on the pattern, repeating the coating and drying steps until a covering of ceramic mold material of a desired thickness has been built up on at least part of the pattern, said steps of repetitively coating and drying includes the steps of applying an initial covering of ceramic mold material over the body and flange of the pattern and drying the initial covering, said step of coating the pattern further including the step of applying a wet coating of ceramic mold material over the initial covering, said method further including the step of removing a portion of the wet coating overlying the initial covering on the flange of the pattern prior to drying of the wet coating overlying the initial covering, providing a pair of separate mold sections which have mold surfaces with configurations corresponding to the configurations of the side surfaces of the cast product, said step of providing a pair of separate mold sections including the step of destroying the disposable pattern, and thereafter locating the mold surfaces on the separate mold sections in the same spatial relationship as the opposite side surfaces on the cast product by placing in abutting engagement surfaces on the mold sections which were previously disposed on opposite sides of the pattern flange.

28. A method as set forth in claim 27 wherein said step of removing at least a portion of the wet dip coating includes the step of wiping a portion of the initial covering.

29. A method of making a ceramic mold assembly for use in forming a cast product, said method comprising the steps of providing a pattern having a body section connected with a gating section, the pattern body section having a first major side surface with a configuration corresponding to a first surface area of the cast product, a second major side surface with a configuration corresponding to a second surface area of the cast product and minor side surfaces interconnecting the major side surfaces of the pattern body section, the pattern gating section being connected with the first major side surface of the pattern body section and having a configuration corresponding to the configuration of a portion of the mold assembly through which molten metal flows to a mold cavity during a casting operation, said method further including the steps of applying a wet coating of liquid ceramic mold material over the pattern body section and at least a portion of the gating section, removing at least a major portion of the wet coating of ceramic mold material overlying a plurality of minor side surfaces of the pattern body section to at least partially separate the portion of the wet coating of ceramic mold material overlying the first major side surface of the pattern body section from the portion of the wet coating of ceramic mold material overlying the second major side surface of the pattern body section, at least partially drying the wet coating of ceramic mold material overlying the pattern body section and gating section after performing said steps of removing the wet coating of ceramic mold material overlying the minor side surfaces of the pattern body section, separating the pattern body section and gating section from the dried coating of ceramic mold material to provide a first ceramic mold section connected with a ceramic mold gating section and a second ceramic mold section which is separate from the first mold section and the mold gating section, and interconnecting the first and second ceramic mold sections to at least partially define a mold cavity connected in fluid communication with the mold gating section.

30. A method of making a ceramic mold assembly for use in forming a cast product, said method comprising the steps of providing a pattern having a main pattern section and first and second flange pattern sections connected with opposite end portions of the main pattern section and extending transversely to the main pattern section, the main pattern section having a first major side surface with a configuration corresponding to a first surface area of the cast product and a second major side surface with a configuration corresponding to a second surface area of the cast product, the first and second flange pattern sections each having a first major side surface connected with an end portion of the main pattern section and projecting outwardly of the first and second major side surfaces of the main pattern section, said method further including the steps of repetitively applying wet coatings of ceramic mold material over the pattern, at least partially drying each of the wet coatings of ceramic mold material in turn, separating at least some of the wet coatings of ceramic mold material into a plurality of segments before drying these coatings, said step of separating a wet coating of ceramic mold material into a plurality of segments including the steps of forming the wet coating of ceramic mold material into a first segment overlying the first major side surface of the main pattern section and portions of the first and second flange pattern sections and a second segment overlying the second major side surface of the main pattern section and portions of the first and second flange pattern sections, said steps of forming the wet coating of ceramic mold material into first and second segments including the steps of removing at least a major portion of the wet coating of ceramic mold material overlying minor side surfaces of the main pattern section and surface areas of the first and second flange pattern sections, separating the first and second segments of the coating of ceramic mold material overlying the major side surfaces of the main pattern section and first and second flange pattern sections from the pattern by destroying the pattern after performing said steps of applying and drying coatings of ceramic mold material, and thereafter interconnecting the first and second segments of ceramic mold material to at least partially form the mold assembly, said step of interconnecting the first and second segments of ceramic mold material including the step of forming joints in association with the portions of the first and second segments of ceramic mold material which previously overlaid the first and second flange pattern sections.

31. A method of making a mold assembly for use in casting a circular wall, said method comprising the steps of providing a plurality of disposable arcuate wall patterns, applying a wet coating of liquid ceramic mold material to each of the arcuate wall patterns, at least partially drying the wet coating of liquid ceramic mold material on each of the arcuate wall patterns, forming a plurality of separate arcuate mold sections made of ceramic mold material by disposing of the patterns after performing said steps of applying and drying a coating of ceramic mold material, said step of forming separate arcuate mold sections including the steps of forming a first plurality of arcuate mold sections each of which has a surface with a configuration corresponding to the configuration of a portion of a circular radially inner surface area of the circular wall to be cast and forming a second plurality of arcuate mold sections each of which has a surface with a configuration corresponding to the configuration of a portion of a circular radially outer surface area of the circular wall to be cast, said method further including the steps of interconnecting the first plurality of arcuate mold sections in a first circular array of mold sections, and interconnecting the second plurality of arcuate mold sections in a second circular array of mold sections which is circumscribed by the first circular array of mold sections and cooperates with the first circular array of mold sections to at least partially define a circular mold cavity having a configuration corresponding to the configuration of the wall to be cast.

32. A method as set forth in claim 31 wherein each of the arcuate wall patterns has a first major side surface with a configuration corresponding to the configuration of a portion of the circular radially inner surface area of the wall to be cast, a second major side surface with a configuration corresponding to the configuration of a portion of the circular radially outer surface area of the wall to be cast, and a plurality of minor side surfaces interconnecting the major side surfaces, said method further including the step of removing at least a major portion of the wet coating of ceramic mold material overlying minor side surfaces of each of the wall patterns prior to performing said step of drying the wet coating of liquid ceramic mold material.

33. A method as set forth in claim 3 wherein each of the arcuate wall patterns has an outwardly projecting flange portion, said step of applying a wet coating of liquid ceramic mold material to each of the arcuate wall patterns includes the step of applying a coating of ceramic mold material to the flange portion of each of the arcuate wall patterns, said steps of forming first and second pluralities of arcuate mold sections each including the steps of forming arcuate mold sections having projecting flange surfaces of a configuration corresponding to at least a part of the flange portions of the arcuate wall patterns, said steps of interconnecting the first plurality of arcuate mold sections in a first circular array and interconnecting the second plurality of arcuate mold sections in a second circular array includes the step of positioning flange surfaces on adjacent arcuate mold sections in abutting engagement.

* * * * *

UNITED STATES PATENT AND TRADEMARK OFFICE

CERTIFICATE OF CORRECTION

PATENT NO. : 4,066,116

DATED : January 3, 1978

INVENTOR(S) : William S. Blazek et al

It is certified that error appears in the above-identified patent and that said Letters Patent are hereby corrected as shown below:

Column 26, line 9 change "3" to --31--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*